US005853302A

United States Patent [19]

Roman et al.

[11] Patent Number: 5,853,302

[45] Date of Patent: Dec. 29, 1998

[54] DEVICE FOR THE CONNECTION OF ELECTRICAL CONDUCTORS TO A CONTROL UNIT, PREFERABLY FOR AN IRRIGATION CONTROL APPARATUS

[75] Inventors: Gianfranco Roman, Pasiano; Claudio Pasut, Pordenone, both of Italy

[73] Assignee: Claber S.p.A., Veneto, Italy

[21] Appl. No.: 833,497

[22] Filed: Apr. 9, 1997

[30] Foreign Application Priority Data

Apr. 12, 1996 [IT] Italy ..... MI96A0703

[51] Int. Cl.[6] ..... H01R 23/70

[52] U.S. Cl. ..... 439/629; 439/709

[58] Field of Search ..... 439/76.1, 709, 439/801, 629–637; 137/802, 870; 361/728, 730, 752, 736

[56] References Cited

U.S. PATENT DOCUMENTS

| | | | |
|---|---|---|---|
| 3,704,831 | 12/1972 | Clark . | |
| 3,982,698 | 9/1976 | Anderson . | |
| 4,082,117 | 4/1978 | Peckham . | |
| 4,729,059 | 3/1988 | Wang | 439/709 X |
| 4,810,897 | 3/1989 | Shotey . | |
| 5,062,452 | 11/1991 | Johnson . | |
| 5,221,218 | 6/1993 | Marach . | |
| 5,619,012 | 4/1997 | Casali et al. | 439/721 X |

FOREIGN PATENT DOCUMENTS

| | | |
|---|---|---|
| 0 671 782 A1 | 9/1995 | European Pat. Off. . |
| 2 091 049 | 7/1982 | United Kingdom . |

*Primary Examiner*—Khiem Nguyen
*Attorney, Agent, or Firm*—Nixon & Vanderhye

[57] ABSTRACT

A device for the connection of electrical conductor wires to a control unit, preferably for an irrigation control apparatus, comprises a casing comprising a plurality of terminals for the mechanical connection of said electrical wire conductors and an electrical connector provided with a respective plurality of electrical contacts, each associated with a respective terminal so as to be electrically connected to a respective electrical wire conductor, for the electrical coupling with respective electrical contacts on the control unit.

9 Claims, 5 Drawing Sheets

DEVICE FOR THE CONNECTION OF ELECTRICAL CONDUCTORS TO A CONTROL UNIT, PREFERABLY FOR AN IRRIGATION CONTROL APPARATUS

BACKGROUND AND SUMMARY OF THE INVENTION

The present invention relates to a device for the connection of electrical conductors to a control unit, preferably for an irrigation control apparatus.

In the sector of gardening, irrigation control apparatus are known that allow the control in an automatic manner and at a distance of solenoid valves or of pumps for supplying irrigation water.

Such units comprise generally an electronic control unit that controls various peripheral units, typically the opening and the closing of one or more solenoid valves, the turning on and off of electric pumps and that can receive signals from transducers.

For all these purposes, the electronic control unit has to be connected electrically to the solenoid valves, to the electric pumps and to the transducers, allowing at the same time the removability of the electronic computerised nucleus to allow remote programming.

The problem thus arises of how to make the connections between the external conductors that carry the control signals for the solenoid valves and for the electric pumps, or the signals issued by the transducers, and the electronic control unit.

According to the present invention, a device is provided for the connection of electrical wire conductors to a control unit, preferably for an irrigation control apparatus, characterized in that it comprises a casing comprising a plurality of terminals for the mechanical connection of said electrical wire conductors and an electrical connector provided with a respective plurality of electrical contacts, each associated with a respective terminal so as to be electrically connected to a respective electrical wire conductor, for the electrical coupling with respective electrical contacts on the control unit.

Thanks to the device according to the present invention, it is possible to integrate in a casing the functions of terminal board for the mechanical connection of the electrical wires and that of electrical connection of the same wires to the control unit, functions that in the known irrigation control apparatus are provided separately.

The device of the present invention also allows the electronic part of the control unit to be separated from the conductors providing the connection with the solenoid valves, with the electric pumps and with the transducers, if any.

BRIEF DESCRIPTION OF THE DRAWING FIGURES

The features and the advantages of the present invention will be made more evident by the following detailed description of an embodiment thereof, illustrated as a non-limiting example in the enclosed drawings, wherein.

DESCRIPTION OF A PREFERRED EMBODIMENT

Figure 1:
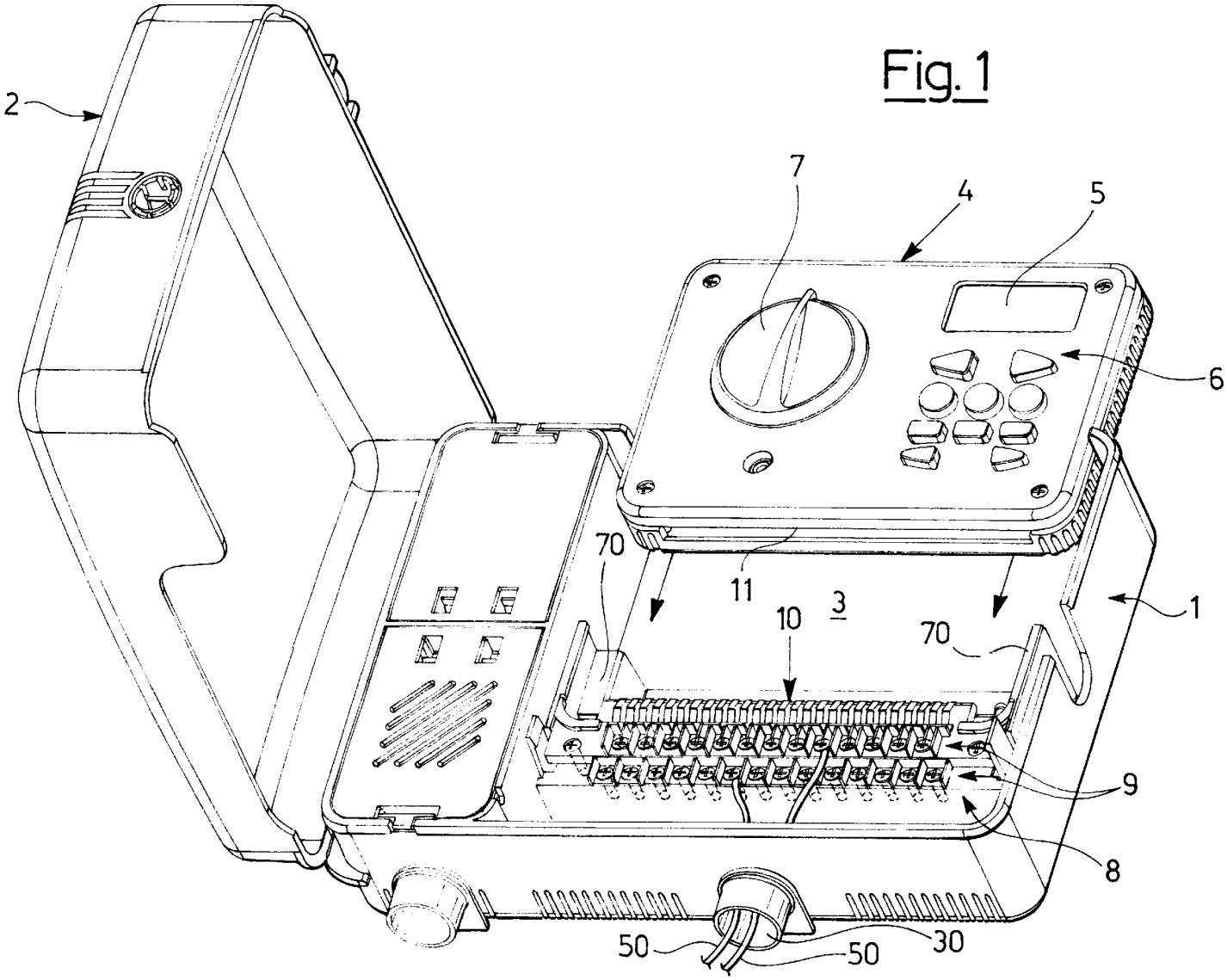
FIG. 1 is an exploded perspective view of an irrigation control apparatus equipped with the device according to the present invention.

With reference to the drawings, there is shown an irrigation control apparatus for use in the sector of gardening.

The unit comprises a box-like case or shell 1 endowed with a cover 2 and inside which there is obtained a space 3 for housing, with the possibility of extraction, a control unit 4. The control unit 4 is generically of the type comprising a display 5, a keyboard 6 and a rotary switch 7. The control unit 4 will not be described in its structural and functional details since that is altogether inessential for the purpose of understanding the present invention.

In the shell 1 there is also housed, in front of the control unit 4, a casing 8 constituting an integrated unit comprising a terminal board 9 and an electrical connector 10. The terminal board 9 allows the connection of electrical conductors 50 that are connected, at the other end, to solenoid valves, or to electrical pumps, or to signal transducers for the transmission of control signals from the control unit to the solenoid valves or to the electrical pumps, or for the transmission of measurement signals from the transducers to the control unit. The connector 10 serves to establish the electrical coupling between the conductors 50 fastened to the terminal board 9 and the control unit 4; for this purpose, the latter is provided with a longitudinal opening inside which the connector 10 can be inserted when the control unit 4 is inserted in the space 3 of the shell 1.

The shell 1 is also provided with an opening 30 for the passage of the conductors 50.

Figure 3:
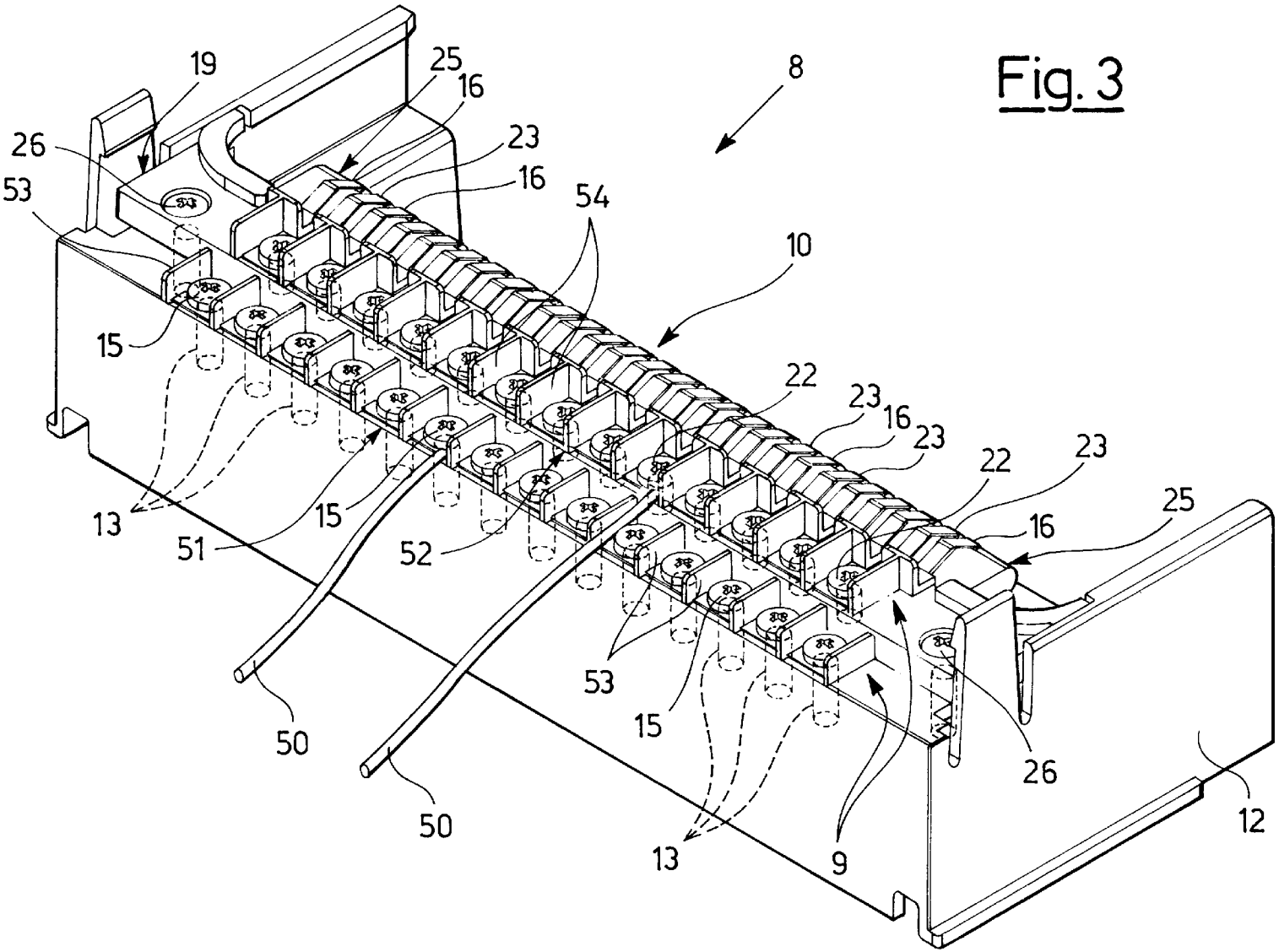
FIG. 3 is a perspective view of the device according to the present invention, disassembled from the unit.

As can be seen better in FIG. 3, that shows on an enlarged scale the casing 8, the latter comprises a main support 12 in electrically insulating material, preferably plastic, that has two parallel sets 51 and 52 of terminals, one lower and the other upper, each terminal 51, 52 comprising a respective screw 15 or 22 and being separated from the adjacent terminals by respective plates 53 and 54 in insulating material. To each terminal it is possible to fasten mechanically, by means of the screw 15 or 22, a respective electrical conductor 50, for example a cable of copper with insulating sheath. In the figures, only two conductors 50 have been shown, so as not to make the drawings excessively confusing. The terminals of the two sets 51 and 52 are intercalated one with the other, in the sense that proceeding in the longitudinal direction of the two sets, between two generic terminals of the lower set 51 there is always interposed a terminal of the upper set 52.

Figure 4:
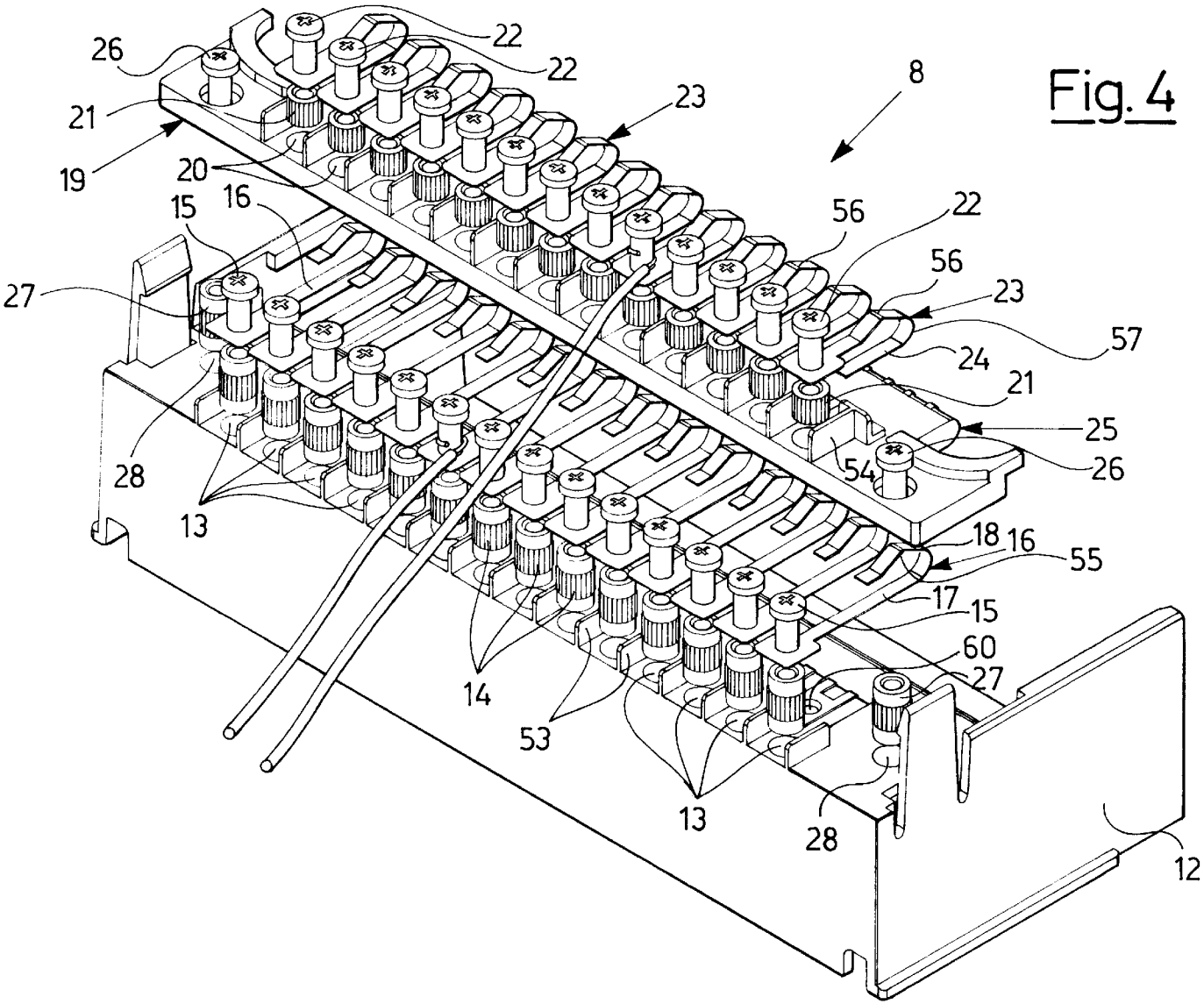
FIG. 4 is an exploded perspective view of the device shown in FIG. 3.

The structure and the components of the casing 8 can be seen in their entirety in the exploded perspective view of FIG. 4. As can be seen, in the main support 12 there is a longitudinal succession of holes 13, one for each terminal of the set suitable for receiving respective bushes 14 having a portion of external surface knurled so as to provide friction with the walls of the holes 13. The bushes 14 are threaded internally to receive the respective screws 15; the latter allow the conductors 50 be tightened on conductor laminas 16, typically metallic, preferably of copper, that have an extended portion 17, a portion 18 curved upward by about 180 and a terminal portion 55 bent to form a projection protruding upward. The conductors 50, once the screws 15 have been tightened, will be in close mechanical and electrical contact with the respective laminas 16.

The casing 8 also comprises a second support 19 also provided with a longitudinal succession of holes 20 suitable for receiving inside them respective bushes 21 knurled externally and threaded internally to receive respective screws 22. The screws 22 allow the conductors 50 to be tightened on respective conductor laminas 23 that have an initial portion 56 bent to form a projection protruding upward, a portion 57 curved downward by about 180° and a rectilinear terminal portion 24. The conductors 50, once the screws 22 have been tightened, will be in close mechanical and electrical contact with the respective laminas 23.

In the main support 12 there is also obtained a second longitudinal succession of holes 60, staggered with respect to the holes 13 and internally threaded, to receive the ends of the screws 22.

The second support 19 also has a protruding longitudinal appendix 25 with rounded end and in which end there are obtained slightly hollowed seats to receive the laminas 16 and 23, that will be intercalated one with the other. Thanks to their conformation, the conductor laminas wind themselves round the appendix 25, with the protruding projections 55 and 56 facing upward (FIG. 3).

In this way, at the appendix 25 on which the laminas 16 and 23 are wound, an electrical connector is made.

Figure 2:
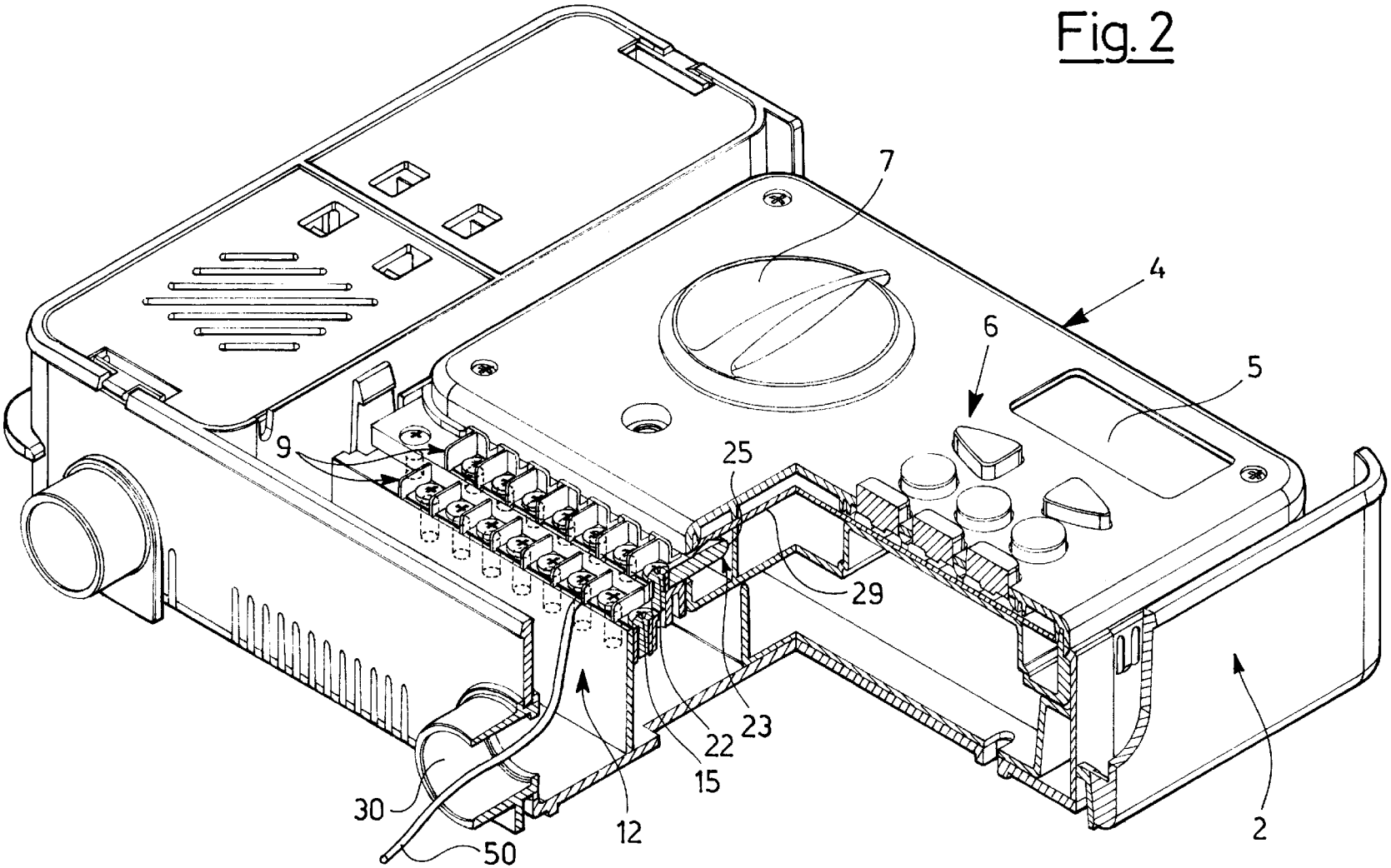
FIG. 2 is a partially sectioned perspective view of the unit shown in FIG. 1.
Figure 5:
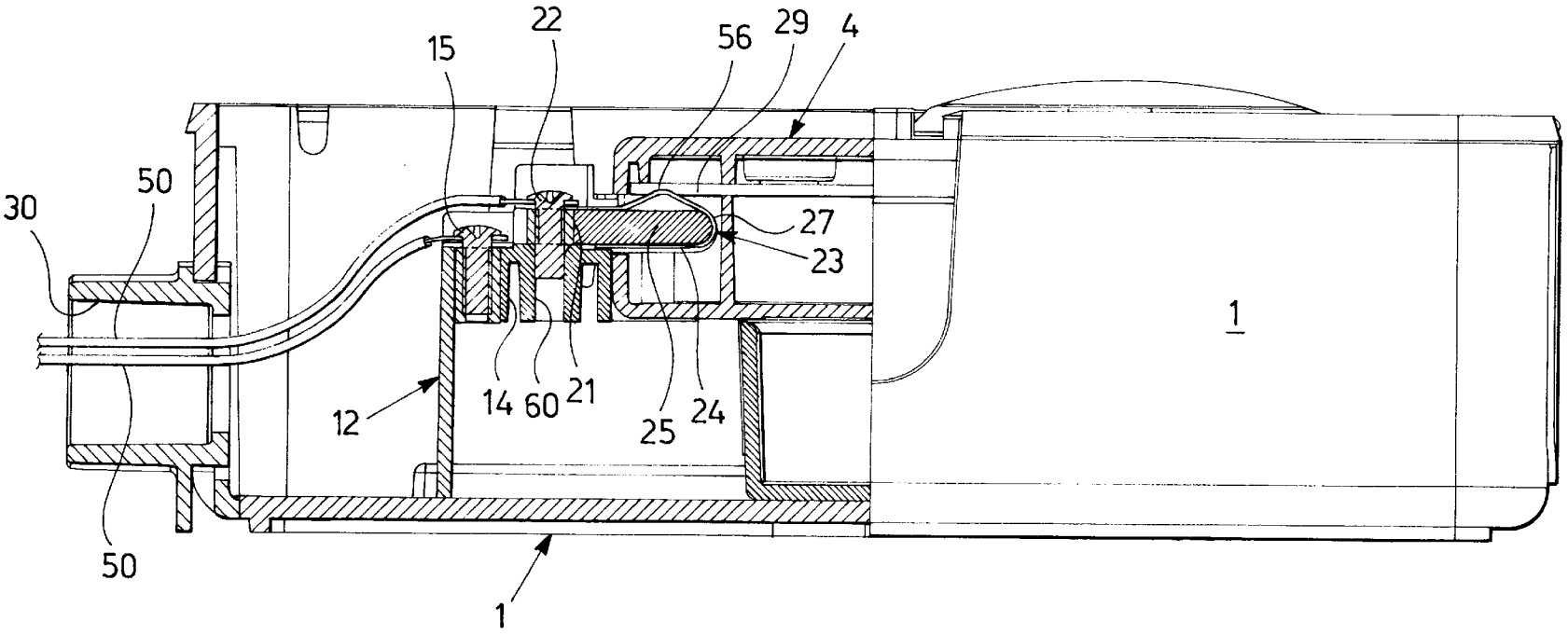
FIG. 5 is a cross-sectional view of the unit of FIG. 1 once it has been assembled, taken along a vertical plane transversal to the connection device.

As can be seen in FIG. 2 and in FIG. 5, when the control unit 4 is inserted in its seat in the shell 1, the appendix 25 with the laminas 16 and 23 wound on it is inserted in the longitudinal opening 11 of the control unit. In order to facilitate the correct insertion of the control unit 4 and in order to ensure that the same maintains its position, two guides 70 are obtained in the support 12. Inside the control unit, the projections 55 and 56 of the laminas 16 and 23 enter into mechanical and electrical contact with as many conductors tracks made on a printed circuit board 29 of the control unit on which the suitable electronic components are mounted. The electrical contact between the conductors 50 and the electronics of the control unit 4 is thus made.

It should be observed that thanks to the integrated terminal board-conductor unit according to the present invention, the functions of mechanical terminal board and that of electrical connection with the control unit, that in known irrigation control apparatus are made separately, have been combined in a single unit.

The terminal board-conductor unit of the present invention also allows the electronic part of the control unit to be separated from the conductors connecting the solenoid valves, the electric pumps and the transducers, if any.

What is claimed is:

1. A device for the connection of electrical wire conductors to a control unit, preferably for an irrigation control apparatus, comprising a casing of electrically isolating material, a terminal board including a plurality of separate metallic terminals arranged in respective separate seats of said casing for the mechanical and electrical connection of respective electrical wire conductors and an electrical connector provided with a corresponding plurality of separate electrical contacts which are mechanically and electrically connected to respective terminals of the terminal board and are mechanically and electrically connectable to respective electrical contacts on the control unit, said terminals being electrically isolated from one another by said electrically isolating material intervening between said terminals.

2. A device according to claim 1, characterized in that each terminal comprises means for the mechanical connection of a respective electrical conductor wire to a respective lamina of electrically conducting material, said lamina extending to form a respective electrical contact of said connector.

3. A device according to claim 2, characterized in that said casing comprises a support in electrically insulating material that supports said terminals, said support also comprising an appendix suitable for supporting said laminas.

4. A device according to claim 3, characterized in that said laminas comprises a substantially rectilinear portion extending from the respective terminal, and a portion bent round said appendix.

5. A device according to claim 4, characterized in that said laminas comprise a curved portion so as to determine a projection suitable for cooperating with a respective contact of the control unit.

6. A device according to claim 5, characterized in that said means for the mechanical connection of a respective electrical wire conductor to a respective lamina comprise a screw.

7. A device for connection of electrical wire conductors to a control unit comprising:

a casing of electrically isolating material;

a terminal board including first and second sets of separate metallic terminals lying in discrete rows thereof, respectively, the terminals of each discrete set being separated from one another and the terminals in each row being separated from one another by said electrical insulating material, the row of said first set of terminals lying at an elevation along said terminal board below said row of said second set of terminals;

an electrical connector including a corresponding plurality of separate electrical contacts which are mechanically and electrically connected to respective terminals of the terminal board and are mechanically and electrically connectable to respective electrical contacts on the control unit; and an elongated projection carrying said contacts, the contacts connected to said first and second sets of terminals being turned about an edge of said projection common to said contacts and alternating with one another for connection to the respective electrical contacts on the control unit.

8. A device according to claim 7 wherein said first and second sets of terminals are carried by first and second supports, respectively, said projection projecting from said second support with said contacts turning approximately 180° about said common edge to form a longitudinally aligned array of contacts for connection with the contacts of the control unit.

9. A device according to claim 7 wherein the contacts of said first and second sets are turned approximately 180° about said projection in respective opposite directions relative to one another.

* * * * *

UNITED STATES PATENT AND TRADEMARK OFFICE

CERTIFICATE OF CORRECTION

PATENT NO. : 5,853,302
DATED : December 29, 1998
INVENTOR(S) : Gianfranco Roman and Claudio Pasut

It is certified that error appears in the above-identified patent and that said letters patent is hereby corrected as shown below:

Cover page item [73] should read -- Claber S.p.A., Fiume Veneto, Italy --

Signed and Sealed this

Fifth Day of October, 1999

*Attest:*

Q. TODD DICKINSON

*Attesting Officer*

*Acting Commissioner of Patents and Trademarks*